US006604265B2

(12) United States Patent
Giampavolo

(10) Patent No.: US 6,604,265 B2
(45) Date of Patent: Aug. 12, 2003

(54) CHILD RESISTANT BUCKLE

(76) Inventor: Paul Giampavolo, 10 Kingsbridge Rd., Fairfield, NJ (US) 07004

( * ) Notice: Subject to any disclaimer, the term of this patent is extended or adjusted under 35 U.S.C. 154(b) by 0 days.

(21) Appl. No.: 09/952,070

(22) Filed: Sep. 13, 2001

(65) Prior Publication Data

US 2002/0073521 A1 Jun. 20, 2002

Related U.S. Application Data

(60) Provisional application No. 60/232,546, filed on Sep. 14, 2000.

(51) Int. Cl.[7] ..... A44B 17/00; A44B 11/25; A44B 11/26

(52) U.S. Cl. ..... 24/615; 24/614

(58) Field of Search ..... 24/614, 615, 633, 24/629, 625, 664, 647

(56) References Cited

U.S. PATENT DOCUMENTS 4,991,272 A * 2/1991 Bianchi ..... 24/616
5,465,472 A * 11/1995 Matoba ..... 24/625
5,546,642 A * 8/1996 Anscher ..... 24/625
5,791,026 A * 8/1998 Anscher ..... 24/615
5,794,316 A * 8/1998 Anscher ..... 24/625
D405,723 S * 2/1999 Anscher ..... D11/216
6,052,875 A * 4/2000 Fudaki ..... 24/625
6,148,486 A * 11/2000 Uehara et al. ..... 24/170
6,263,549 B1 * 7/2001 Uehara ..... 24/625

* cited by examiner

*Primary Examiner*—Robert J. Sandy
(74) *Attorney, Agent, or Firm*—Ostrolenk, Faber, Gerb & Soffen, LLP

(57) ABSTRACT

A buckle with male and female mating parts, in which the male part includes features to prevent disengagement operation by a child. The child resistant features include added ribs, webbing in the form of flanges or struts, or barbs or prongs that increase the difficulty for disengaging the buckle. The buckle can be operated easily by an adult, while remaining secure from disengagement by a typical child.

10 Claims, 4 Drawing Sheets

MALE

FEMALE

MALE

FEMALE

MALE

FEMALE

MALE

FEMALE

CHILD RESISTANT BUCKLE

This application is based upon and claims benefit of application No. 60/232,546, filed Sep. 14, 2000, entitled CHILD RESISTANT BUCKLE, to which a claim of priority is hereby made.

BACKGROUND OF THE INVENTION

The present invention is directed to a child resistant buckle and, in particular, to an improvement in the type of buckle commonly used in many children's safety seats, strollers, baby carriages, shopping cart seat belts, etc. For example, these type buckles are used as the buckles for children's safety straps which are applied to shopping carts. The prior art buckle is made, for example, by Illinois Tool Works (ITW) and others and is well known. This buckle is argued by some to suffer from the disadvantage that the two latch members 10 of the male part 20 which slide into a slot 12 of the female part 30 and have barbed ends 14 which engage in the female part, can be manipulated, by some young children, so as to allow the buckle to be undone. As is well known, the two barbed ends 14 are pressed toward each other to allow the male part of the buckle to be removed from the female part.

Others have attempted to provide a child resistant buckle. For example, see Gallbreath, U.S. Pat. No. 5,991,985 which provides a third fastening element and includes a depressable button to allow the third fastening element to be undone. This buckle is cumbersome because it requires that the user learn an additional motion in order to undo it, i.e., the user must at the same time depress the side latches and the center button to undo the buckle.

SUMMARY OF THE INVENTION

It is an object of the present invention to overcome the drawbacks associated with the prior art.

It is a further object of the present invention to provide a simple child resistant buckle with a design and operating features similar to those provided in the prior art.

Briefly stated, according to the present invention there is provided a buckle with male and female mating parts, in which the male part includes features to prevent disengagement operation by a child. The child resistant features include added ribs, webbing in the form of flanges or struts, or barbs or prongs that increase the difficulty for disengaging the buckle. The buckle can be operated easily by an adult, while remaining secure from disengagement by a typical child.

DETAILED DESCRIPTION OF THE PREFERRED EMBODIMENTS

Figure 1:
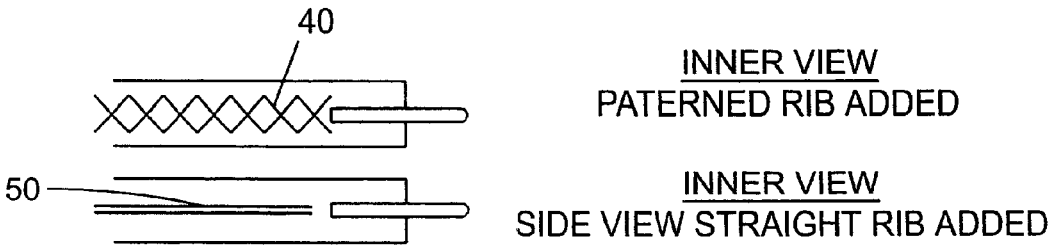
FIG. 1 is a plan view of a male and female mating connectors according to a first embodiment of the present invention.
Figure 1:
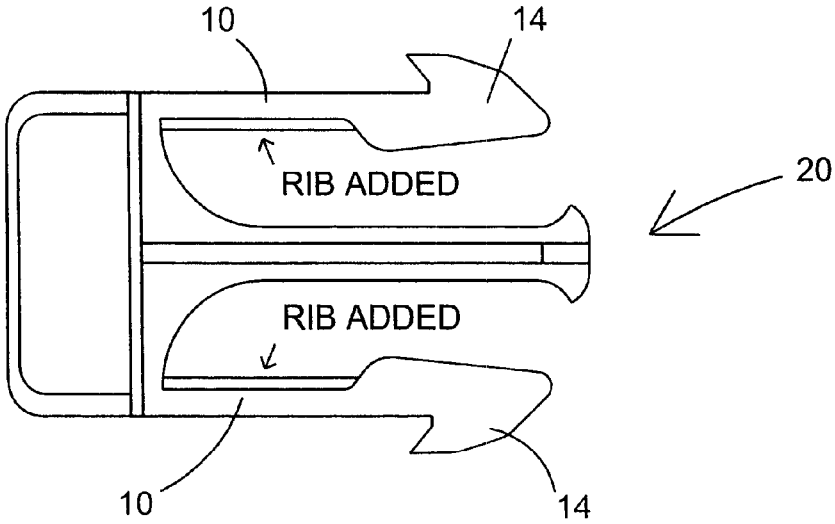
Figure 1:
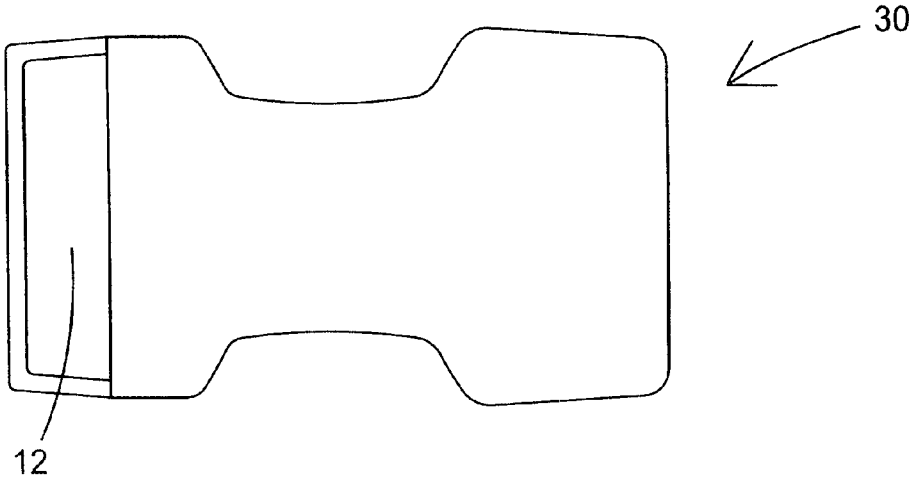
Figure 2:
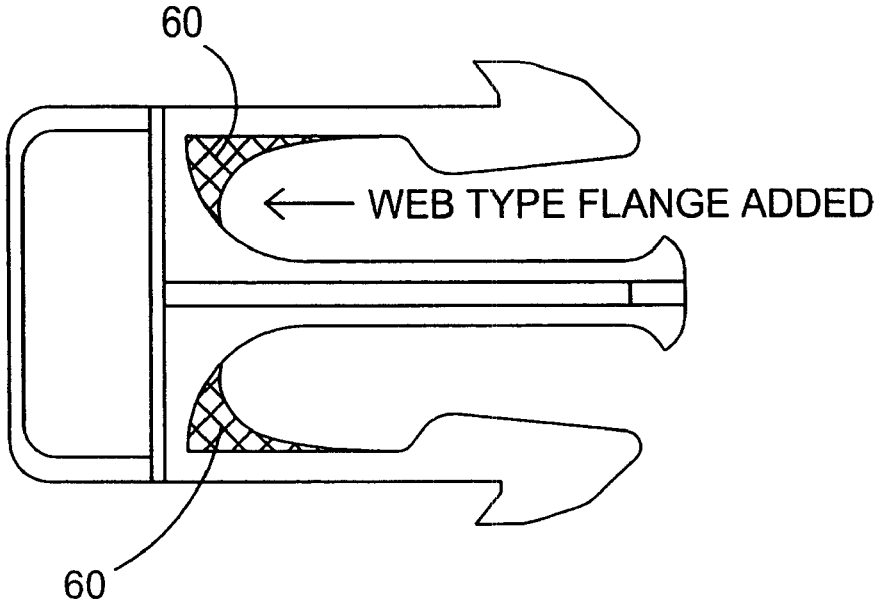
FIG. 2 is a plan view of the male and female connectors of a second embodiment according to the present invention.
Figure 2:
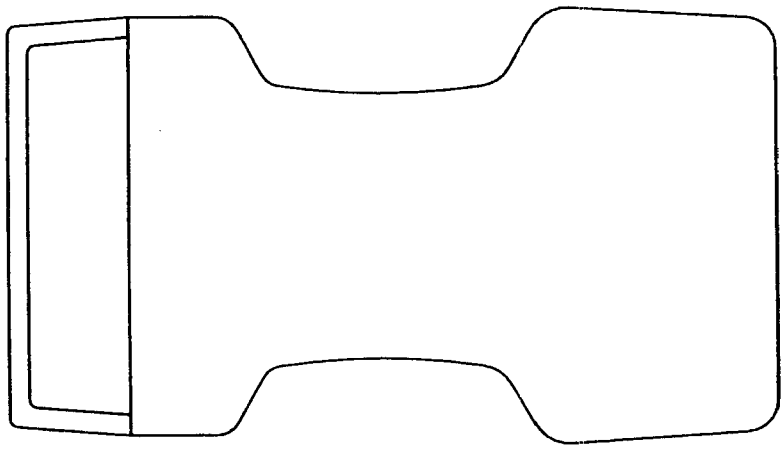
Figure 3:
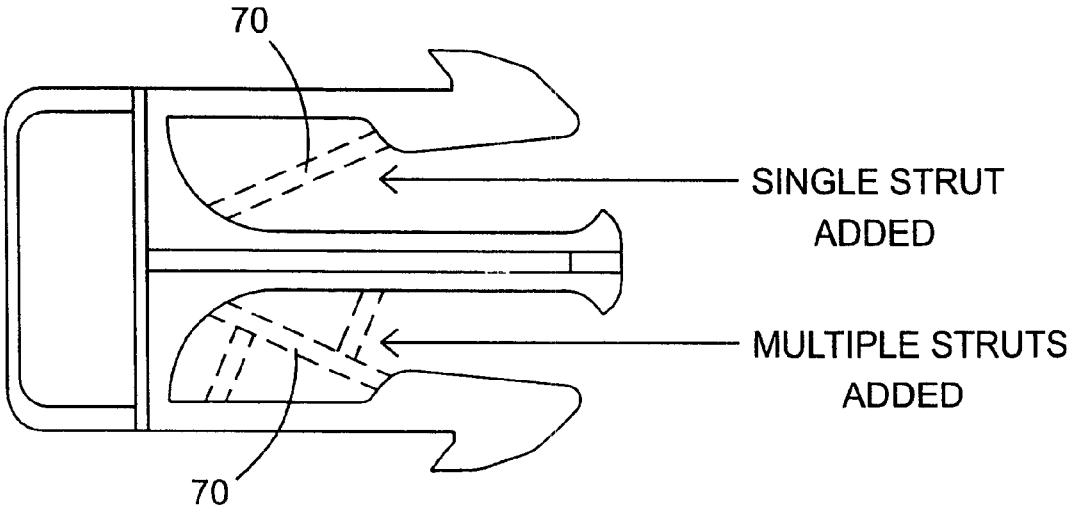
FIG. 3 is a plan view of a male and female buckle part according to a third embodiment of the present invention.
Figure 3:
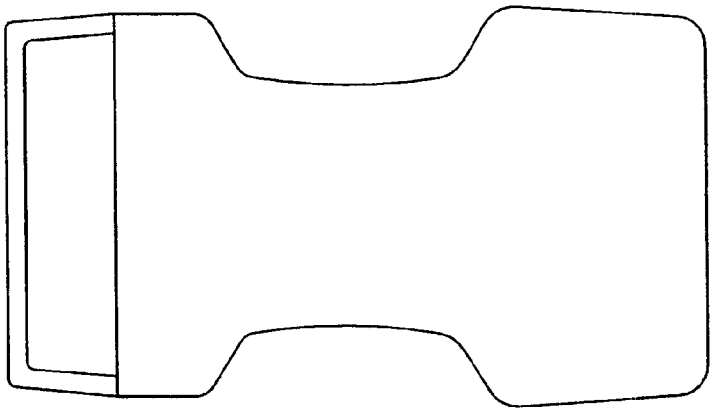
Figure 4:
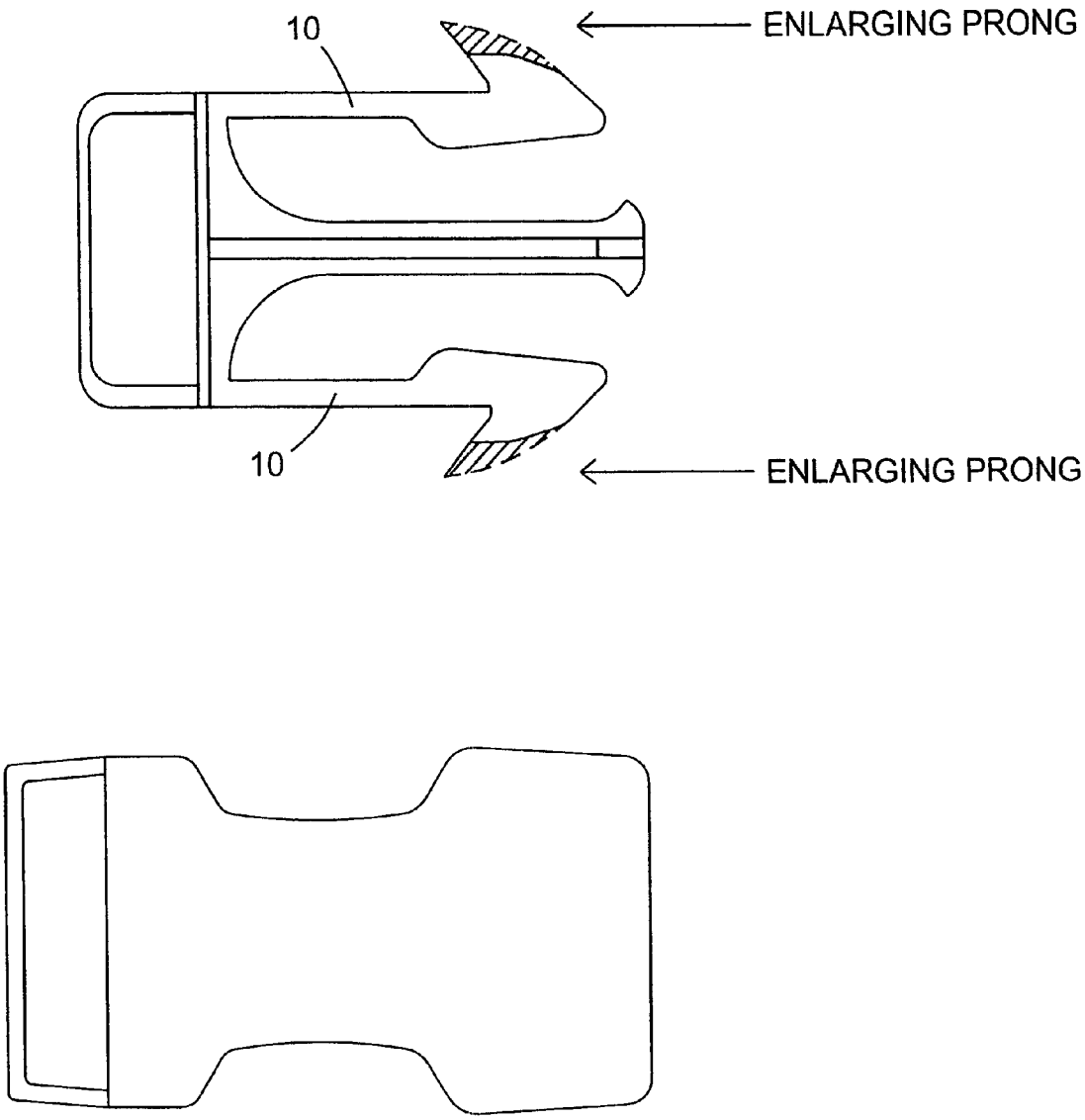
FIG. 4 is a plan view of a male and female buckle part according to a fourth embodiment of the present invention.

The present invention provides a simpler child resistant buckle whose design and operating features are the same as the prior art buckle made by ITW and others. Accordingly, it is operated in the same way to undo the buckle and thus more easily used by consumers. In contrast to the prior art ITW buckle, however, the amount of force required to undo the buckle is increased, thereby preventing young children from undoing the buckle. Referring to FIGS. 1–4, in order to make the prior art buckle child resistant, according to one embodiment, the side latches 10 are reinforced with a strengthening structure to increase the force necessary to undo the buckle. For example, as shown in the drawings, a patterned rib 40 or straight rib 50 may be added, webbing 60 can be added in the form of a flange or struts 70, either single or multiple struts, which are collapsible upon the application of a threshold force can be provided. According to another embodiment, as shown in the attached drawings (FIG. 4), the barbs or prongs are enlarged so that it is required that the side latches 10 be depressed further to enable them to be undone.

The invention provides a simpler, more intuitive way of providing a child resistant buckle and which utilizes the same releasing actions as in the prior art buckle so that consumers will be accustomed to its use the first time it is used. The buckle only requires that a greater force be applied to undo it. The force required should be enough so that the buckle is incapable of being undone by a typical child but can be operated by the children's parents or guardians or other adult supervisors.

Although ribs, struts, webs, flanges and enlarged barbs are shown, other embodiments can be developed which are in accordance with the concepts disclosed herein. Further, combinations of the above embodiments can be provided. Further, the enlarged prongs or barbs of FIG. 4 can be provided along with strengthened latch parts as in FIGS. 1 to 3. Further, the invention is preferably used with a polymer known as ST801, in formulations greater than 50%, although it can be used with other polymers or other formulations.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A buckle, comprising:

a female portion with lateral supports near a first end;

a male portion with lateral resiliently flexible tangs each having an inner region opposing each other;

said lateral supports can receive said tangs when said male portion is inserted into said female portion;

said tangs being urged towards each other upon being received by said lateral supports;

said tangs having a length sufficient to extend beyond said lateral supports when said male portion is completely inserted into paid female portion, whereby said tangs are no longer urged towards each other and abut an inner end of said lateral supports to resist withdrawal of said male portion from said female portion; and a structural member on said inner region of at lest one of said tangs sufficient to increase an urging force needed to move said fangs towards each other to permit withdrawal of said male portion from said female portion.

2. The buckle according to claim 1, wherein said structural member is a rib aligned along a length of said at least one tang.

3. The buckle according to claim 1, wherein said structural member is a flange attached between said at least one rang and a body member of said male portion.

4. The buckle according to claim 1, wherein said structural member includes at least one strut connected between said at least one tang and a body member of said male portion.

5. A buckle, comprising:

a female portion with lateral supports near a first end;

a male portion with lateral resiliently flexible tangs each having an inner region opposing each other;

said lateral supports can receive said tangs when said male portion is inserted into said female portion;

said tangs being urged towards each other upon being received by said lateral supports;

said tangs having a length sufficient to extend beyond said lateral supports when said male portion is completely inserted into said female portion, whereby said tangs are no longer urged towards each other and abut an inner end of said lateral supports to resist withdrawal of said male portion from said female portion; and an enlarged protrusion on an end of said at least one tang sufficient to increase an urging force applied to said tangs and a displacement distance to be traversed by said at least one tang to free said at least one tang from said female portion to permit said male portion to be withdrawn from said female portion.

6. A child resistant buckle, comprising:

a female part with an opening on a first end having opposed walls extending a distance away from said opening, at least one of said walls having an end surface opposed to said opening;

a male part having a base and laterally resilient flexible tangs coupled to said base and extending a length away from said base;

said opposed walls being cooperative with said tangs when said male part is inserted into said female part to urge said tangs towards each other;

said length of said tangs being greater than said distance of said walls such that said tangs extend beyond said walls when said male part is sufficiently inserted into said female part, such that at least one of said tangs engages said end surface of said at least one wall to resist withdrawal of said male part from said female part; and an extended protrusion connected to said at least one tang sufficient to increase a displacement distance traversed by said at least one tang to disengage said tang from said end surface to permit withdrawal of said male part from said female part, such that a level of difficulty of unbuckling the buckle is increased.

7. A child resistant buckle, comprising:

a female part with an opening on a first end having opposed walls extending a distance away from said opening, at least one of said walls having an end surface opposed to said opening;

a male part having a base and laterally resilient flexible tangs coupled to said base and extending a length away from said base;

said opposed walls being cooperative with said tangs when said male part is inserted into said female part to urge said tangs towards each other;

said length of said tangs being greater than said distance of said walls such that said tangs extend beyond said walls when said male part is sufficiently inserted into said female part, such that at least one of said tangs engages said end surface of at least one of said walls to resist withdrawal of said male part from said female part; and a web structure between said base and said at least one tang to increase an urging resistance of said tangs when urged towards each other, such that a force sufficient to disengage said at least one tang from said end surface to permit withdrawal of said male part from said female part is increased, such that a level of difficulty of unbuckling the buckle is increased.

8. The buckle according to claim 7, wherein said web structure extends along a portion of said at least one tang, such that said at least one tang exhibits greater flexion in a region where said web structure does not extend.

9. A buckle, comprising:

a female part with an opening on a first end having opposed walls extending a distance away from said opening, at least one of said walls having an end surface opposed to said opening;

a male part having a base arid laterally resilient flexible tangs coupled to the base and extending a length away from the base and each having an outer edge;

a structural member connected to at least one of said tangs sufficient to resist compression and increase an urging force applied to said outer edges sufficient to displace said tangs towards each other;

said opposed walls being cooperative with said tangs when said male part is inserted into said female portion to urge said tang towards each other;

said length of said tangs being greater than said distance of said walls such that said tangs extend beyond said walls when said male part is sufficiently inserted into said female part, such that said at least one tang abuts said end surface of at least one of said walls to resist withdrawal of said male part from said female part; and said outer edge of said at leapt one tang being accessible through said female part to permit application of said increased urging force to displace said tangs towards each other to prevent said at least one tang from abutting said end surface of said at least one wall to permit withdrawal of said male part from said female part.

10. The buckle according to claim 9, wherein said structural member is a web extending between said at least one tang and said base of said male part.

* * * * *